US011988116B2

(12) United States Patent
Chui

(10) Patent No.: US 11,988,116 B2
(45) Date of Patent: May 21, 2024

(54) COMBINED VALVE ACTUATING DEVICES WITH SPECIALIZED ACTUATING CAMS FOR HYDRAULIC LASH SELF-ADJUSTMENT

(71) Applicant: JIANGSU JOINTEK PRECISION MACHINERY CO., LTD., Jiangsu (CN)

(72) Inventor: Lap Lam Chui, Changzhou (CN)

(73) Assignee: JIANGSU JOINTEK PRECISION MACHINERY CO., LTD., Changzhou (CN)

( * ) Notice: Subject to any disclaimer, the term of this patent is extended or adjusted under 35 U.S.C. 154(b) by 0 days.

(21) Appl. No.: 18/485,877

(22) Filed: Oct. 12, 2023

(65) Prior Publication Data

US 2024/0052762 A1 Feb. 15, 2024

Related U.S. Application Data

(63) Continuation-in-part of application No. PCT/CN2022/089486, filed on Apr. 27, 2022.

(30) Foreign Application Priority Data

Jan. 25, 2022 (CN) ..... 202210084721.X

(51) Int. Cl.
*F01L 1/24* (2006.01)
*F01L 1/18* (2006.01)

(52) U.S. Cl.
CPC ..... *F01L 1/24* (2013.01); *F01L 1/181* (2013.01); *F01L 1/2411* (2013.01); *F01L 2001/2444* (2013.01)

(58) Field of Classification Search
None
See application file for complete search history.

(56) References Cited

U.S. PATENT DOCUMENTS 6,439,195 B1 * 8/2002 Warner ..... F02D 13/0246 123/90.46
2007/0144472 A1 * 6/2007 Yang ..... F01L 13/085 123/90.22

(Continued)

FOREIGN PATENT DOCUMENTS

CN 203097985 U * 7/2013 ..... F01L 13/0036
CN 104500164 A * 4/2015 ..... F01L 1/18

(Continued)

OTHER PUBLICATIONS

First Office Action in Chinese Application No. 202210084721.X dated Mar. 10, 2022, 13 pages.

(Continued)

*Primary Examiner* — Wesley G Harris
(74) *Attorney, Agent, or Firm* — Porus IP LLC

(57) ABSTRACT

Embodiments provide combined valve actuating device with specialized actuating cams for hydraulic lash self-adjustment, including an actuator fixedly mounted on a rocker arm shaft and a rocker arm mounted with a hydraulic lash adjuster. The actuator is provided with a primary piston and an actuating piston. An actuating oil line is disposed between the primary piston hole and the actuating piston hole. The actuating oil line is connected to an oil supply line through a positioning and pressure control unit. A hydraulic linkage is formed between the primary piston and the secondary piston and an actuating valve is opened when oil is supplied to the actuating oil line.

8 Claims, 8 Drawing Sheets

(56) References Cited

U.S. PATENT DOCUMENTS

| | | | | |
|---|---|---|---|---|
| 2010/0037854 | A1* | 2/2010 | Yang | F02D 13/04 123/321 |
| 2011/0079195 | A1 | 4/2011 | Dilly | |
| 2011/0132298 | A1* | 6/2011 | Ruggiero | F01L 1/2416 123/90.12 |
| 2014/0083381 | A1* | 3/2014 | Roberts | F01L 1/08 123/90.15 |
| 2014/0326212 | A1* | 11/2014 | Baltrucki | F01L 13/06 123/321 |
| 2016/0369659 | A1 | 12/2016 | Junker et al. | |
| 2019/0264584 | A1* | 8/2019 | Baltrucki | F01L 1/2416 |

FOREIGN PATENT DOCUMENTS

| | | | | | |
|---|---|---|---|---|---|
| CN | 106194306 | A | | 12/2016 | |
| CN | 106640257 | A | | 5/2017 | |
| CN | 210178433 | U | | 3/2020 | |
| CN | 112253280 | A | | 1/2021 | |
| CN | 113123843 | A | | 7/2021 | |
| CN | 113818943 | A | | 12/2021 | |
| CN | 113833544 | A | | 12/2021 | |
| CN | 114109551 | A | | 3/2022 | |
| DE | 102013215622 | A1 | | 2/2015 | |
| EP | 2305968 | A1 | * | 4/2011 | F01L 1/24 |
| GB | 2536927 | A | * | 10/2016 | F01L 1/18 |
| KR | 20110032212 | A | | 3/2011 | |
| KR | 101448779 | B1 | * | 10/2014 | F01L 13/00 |
| WO | WO-2012109780 | A1 | * | 8/2012 | F01L 1/08 |
| WO | WO-2015017057 | A1 | * | 2/2015 | F01L 1/181 |
| WO | WO-2016174493 | A1 | * | 11/2016 | F01L 1/08 |
| WO | WO-2017157413 | A1 | * | 9/2017 | F01L 1/08 |
| WO | WO-2019040733 | A1 | * | 2/2019 | F01L 1/181 |

OTHER PUBLICATIONS

Decision to Grant a Patent in Chinese Application No. 202210084721.X dated Mar. 25, 2022, 6 pages.

International Search Report in PCT/CN2022/089486 dated Nov. 1, 2022, 8 pages.

Written Opinion in PCT/CN2022/089486 dated Nov. 1, 2022, 8 pages.

* cited by examiner

COMBINED VALVE ACTUATING DEVICES WITH SPECIALIZED ACTUATING CAMS FOR HYDRAULIC LASH SELF-ADJUSTMENT

CROSS-REFERENCE TO RELATED APPLICATIONS

This application is a Continuation-in-part of International Application No. PCT/CN2022/089486, filed on Apr. 27, 2022, which claims priority to Chinese Patent Application No. 202210084721.X, filed on Jan. 25, 2022, the entire contents of which are hereby incorporated by reference.

TECHNICAL FIELD

The present disclosure relates to the technical field of engine valve actuating devices, and in particular, to a combined valve actuating device with a specialized actuating cam for hydraulic lash self-adjustment.

BACKGROUND

The concept and operation of a compression-released engine brake is well-known in a heavy commercial vehicle industry. Cost, power, reliability, and an engine change requirement are often influential factors that determine whether the engine brake may be adopted. There are several different types of compression-released engine brakes in practice. An engine braking system with a specialized cam is highly favored for independence and high performance.

The existing combined engine valve actuating device may not automatically adjust a valve lash. Although adding a hydraulic lash adjuster may perform hydraulic lash adjustment throughout a whole process, the hydraulic lash adjuster tends to easily over-extend during a process of an engine actuating a lift to increase a subsequent positivity lift of the valve, which in turn affects the positivity lift and braking lift, that is, the hydraulic lash adjuster does not match the combined engine valve actuating device.

SUMMARY

The technical problem to be solved by the present disclosure is to solve the problem that a combined engine valve actuating device in the prior art may not automatically adjust a value lash and a hydraulic lash adjuster is incompatible with the combined engine valve actuating device, a combined valve actuating device with a specialized actuating cam for hydraulic lash self-adjustment is provided.

The technical solution adopted by the present disclosure to solve the technical problem is the combined valve actuating device with the specialized actuating cam for the hydraulic lash self-adjustment, comprising:

an actuator, the actuator having a primary piston slidably mounted in a primary piston hole, an actuating piston slidably mounted in an actuating piston hole, and an actuating oil line connected between the primary piston hole and the actuating piston hole, an inner oil line connected to the actuating piston hole running through the actuating piston, and the actuator being fixedly mounted on a rocker arm shaft;

a rocker arm, the rocker arm being mounted with a hydraulic lash adjuster, the rocker arm being rotationally mounted on the rocker arm shaft, and an oil supply line being disposed on the rocker arm shaft;

a specialized actuating cam, the specialized actuating cam being disposed on one side of a positivity cam of an engine and having a round base component and an actuating lift boss disposed on the round base component;

a valve bridge located below the actuating piston and the hydraulic lash adjuster, the valve bridge having a secondary piston slidably mounted in a secondary piston hole and an oil drain line connected to the secondary piston hole and an actuating valve being connected to the secondary piston, the actuating piston being disposed opposite to the valve bridge, wherein an effective area of action of the actuating piston for being pushed by a liquid in the actuating piston hole and moving in a sliding direction of the actuating piston is smaller than an effective area of action of the secondary piston for being pushed by the liquid in the secondary piston hole and moving in a sliding direction of the secondary piston; and a positioning and pressure control unit, the actuating oil line being connected to an oil supply line through the positioning and pressure control unit, wherein in a case in which the rocker arm does not actuate the valve bridge to be displaced and the oil supply line supplies oil to the actuating oil line, the actuating piston extends out to contact the valve bridge under a hydraulic action of the actuating oil line, and the inner oil line is connected to the oil drain line; when the specialized actuating cam rotates to the round base component and is in a sliding or rolling fit with the primary piston, the primary piston extends out to contact the round base component under the hydraulic action of the actuating oil line; and when the specialized actuating cam rotates to the actuating lift boss and is in the sliding or rolling fit with the primary piston, the positioning and pressure control unit blocks the actuating oil line and the oil supply line, and a hydraulic linkage is formed between the primary piston and the secondary piston to make the actuating lift boss to actuate the actuating valve connected to the secondary piston to be displaced through the primary piston; or in a case in which the rocker arm actuates the valve bridge to be displaced through the hydraulic lash adjuster, the oil drain line and the inner oil line are separated with the displacement of the valve bridge, the hydraulic linkage between the primary piston and the secondary piston is released, oil in the secondary piston hole is drained out, and the secondary piston is reset within the valve bridge.

In order to further facilitate a layout and improve compactness of the structure, the positivity cam is located at one end of the rocker arm, the hydraulic lash adjuster is located at the other end of the rocker arm, the positivity cam, the hydraulic lash adjuster, and the valve bridge are located below the rocker arm, the primary piston, the specialized actuating cam, the actuating piston, and the valve bridge are located below the actuator.

In order to further improve the layout and compactness, the actuating piston is located between the rocker arm shaft and the hydraulic lash adjuster.

In order to realize a rigid hydraulic linkage, the oil supply line unidirectionally supplies oil to the actuating oil line through the positioning and pressure control unit.

In order to further improve the compactness of the structure, the actuator is provided with a shaft hole matching the rocker arm shaft, the rocker arm shaft passes through the shaft hole, and the actuator is fixedly connected to the rocker arm shaft through the positioning and pressure control unit.

In order to facilitate manufacture and simplify an assembly process, the positioning and pressure control unit includes a positioning screw and a unidirectional component, the positioning screw has an oil chamber and an oil inlet line connected to the oil chamber, and the oil supply line is disposed on the rocker arm shaft; and the positioning screw is threadedly connected to the actuator to fix the actuator on the rocker arm shaft, the oil chamber remains connected to the actuating oil line, the oil supply line is connected to the oil inlet line, the unidirectional component is disposed on the positioning screw and the oil inlet line is unidirectionally connected to the oil chamber.

In order to improve the fixing effect, the rocker arm shaft is provided with a positioning surface matching the positioning screw, and an end surface of an inner end of the positioning screw is in contact with the positioning surface.

Further, the unidirectional component includes an elastic element and a unidirectional ball, one end of the elastic element is against an inner wall of the oil chamber, and the other end is against a connection between the oil inlet line and the oil chamber.

Further, the actuating oil line includes a primary piston oil line in the actuator and an actuating piston oil line in the actuator, one end of the primary piston oil line is connected to the primary piston hole and the other end of the primary piston oil line is connected to the oil chamber, one end of the actuating piston oil line is connected to the oil chamber, and the other end of the actuating piston oil line is connected to the inner oil line.

Further, the actuator is provided with a primary elastic element used to actuate the primary piston to retract when a pressure is released in the actuating oil line.

Further, the actuator is provided with an actuating elastic element used to actuate the actuating piston to retract when a pressure is released in the actuating oil line, an actuating piston limiting unit is disposed at the actuating piston hole, and the actuating piston limiting unit is configured to limit a maximum stroke of the actuating piston along an axial direction of the actuating piston hole.

The beneficial effects of the present disclosure are that: the actuator of the combined valve actuating device with the specialized actuating cam for the hydraulic lash self-adjustment is fixed on the rocker arm shaft, no power consumption and motion wear of the engine caused by motion friction may occur between the actuator and the rocker arm shaft, and the specialized actuating cam and the primary piston are separated when the actuator does not work, which may effectively reduce the wear between the specialized actuating cam and the primary piston, engine noise, and friction loss, and improve an utilization rate of an output power of the engine; or the specialized actuating cam automatically adjusts the actuating valve through a hydraulic lash when the actuator works, an actuating lift is not affected by an initial lash setting and is stable, consistent, and easy to be used and maintained, at the same time, the actuating oil line can automatically drain oil once every time the positivity cam rotates, and the circulating oil may not cause an accumulation of impurities when the oil is too dirty, thereby improving working stability and reliability.

The combined valve actuating device with the specialized actuating cam for the hydraulic lash self-adjustment compensates for the lash between the hydraulic lash adjuster and the valve bridge under the hydraulic action using the hydraulic lash adjuster, so that automatic hydraulic adjustment of the whole valve with no lash may be achieved, and there is no need to adjust the valve lash when the actuating device is used, which may avoid an influence of a lash change on the actuating drive and positive performance, thereby reducing the engine noise, improving engine timing accuracy, and solving a problem of compatibility between a valve actuating function and a hydraulic lash adjusting function.

Meanwhile, the combined valve actuating device with the specialized actuating cam for the hydraulic lash self-adjustment makes the valve bridge subject to a hydraulic differential force towards the rocker arm using the actuating piston, so as to balance a thrust toward the valve bridge generated on the valve bridge by the hydraulic lash adjuster, thereby preventing the hydraulic lash adjuster from overextending in an actuating lift process and increasing a subsequent valve positivity lift.

BRIEF DESCRIPTION OF THE DRAWINGS

The present disclosure will be further illustrated by way of exemplary embodiments, which will be described in detail by way of the accompanying drawings. These embodiments are not limiting, and in these embodiments the same numbering indicates the same structure, wherein.

Figure 1:
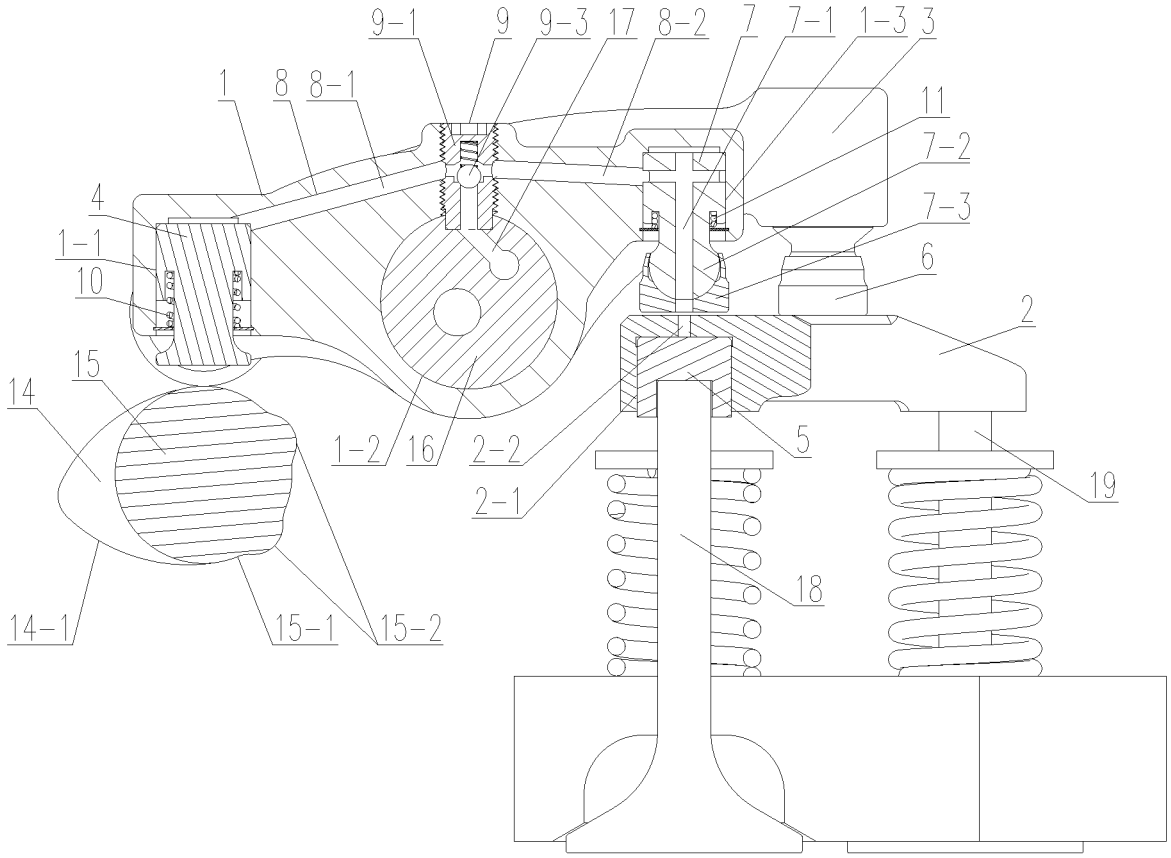
FIG. 1 is a schematic diagram illustrating an exemplary separation between a specialized actuating cam and a primary piston according to some embodiments of the present disclosure.

In the Figures, 1, actuator, 1-1, primary piston hole, 1-2, shaft hole, 1-3, actuating piston hole;

2, valve bridge, 2-1, secondary piston hole, 2-2, oil drain line;

3, rocker arm, 4, primary piston, 5, secondary piston, 6, hydraulic lash adjuster;

7, actuating piston, 7-1, inner oil line, 7-2, actuating piston joint portion, 7-3, actuating piston joint seat, 7-4, oil line area adjusting mechanism, 7-41, adjusting block, 7-42, push rod, 7-5, accommodating groove;

8, actuating oil line, 8-1, primary piston oil line, 8-2, actuating piston oil line;

9, positioning and pressure control unit, 9-1, positioning screw, 9-11, oil chamber, 9-12, oil inlet line, 9-2, elastic element, 9-3, unidirectional ball;

10, primary elastic element, 11, actuating elastic element, 12, primary elastic element support, 13, actuating piston limiting unit;

14, positivity cam, 14-1, primary lift boss;

15, specialized actuating cam, 15-1, round base component, 15-2, actuating lift boss;

16, rocker arm shaft, 16-1, positioning surface; and

17, oil supply line, 18, actuating valve, 19, non-actuating valve.

DETAILED DESCRIPTION

In order to more clearly illustrate the technical solutions of the embodiments of the present disclosure, the following will be a brief description of the accompanying drawings that need to be used in the description of the embodiments. It will be apparent that the accompanying drawings in the following description are only examples or embodiments of the present disclosure, and that other similar scenarios may be applied to the present disclosure by those of ordinary skill in the art, without creative effort. Unless obviously obtained from the context or the context illustrates otherwise, the same numeral in the drawings refers to the same structure or operation.

As shown in the present disclosure and the claims, unless the context clearly indicates otherwise, the terms "one," "a," "an," "one kind," and/or "the" are not limited to singular and may also include plural. Generally, the terms "including" and "comprising" merely indicate the inclusion of specifically identified steps and elements, and these steps and elements do not constitute an exclusive listing. The methods or devices may also include other steps or elements.

Figure 2:
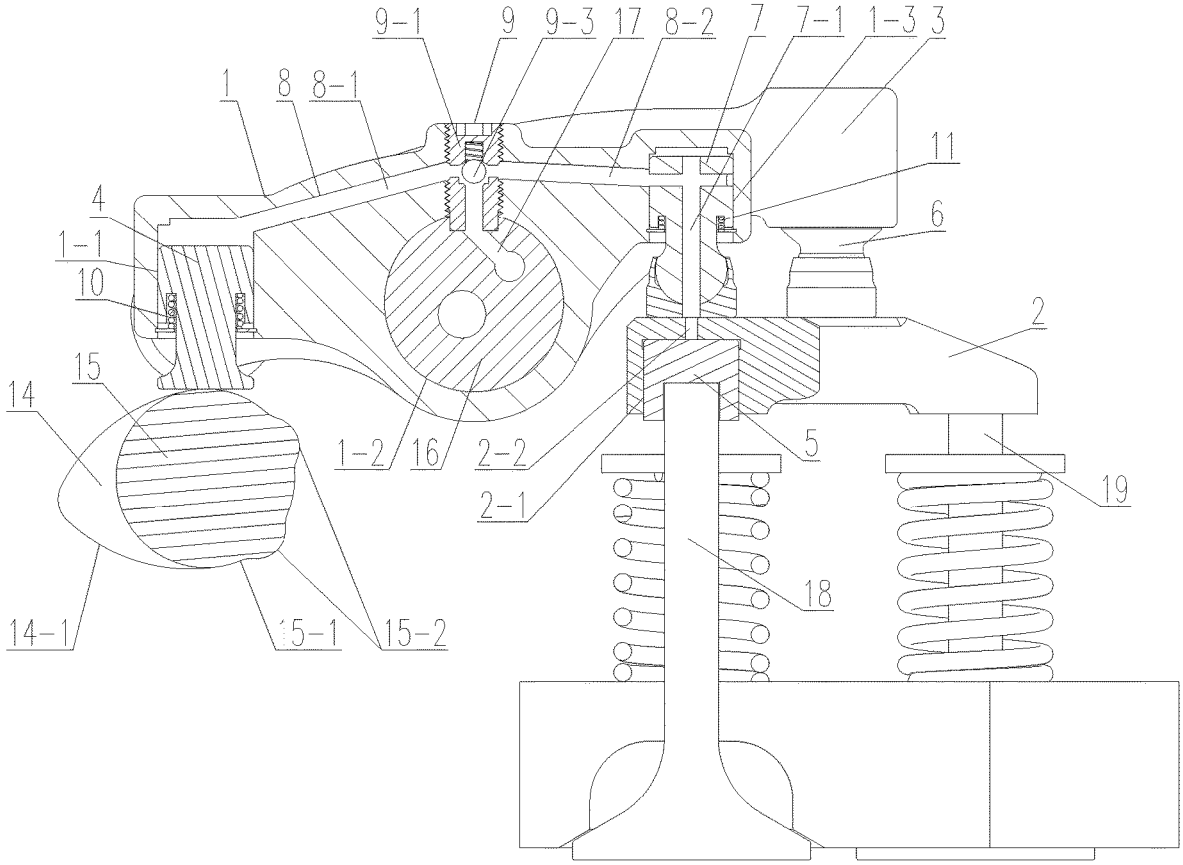
FIG. 2 is a schematic diagram illustrating an exemplary hydraulic linkage formed between a primary piston and a secondary piston according to some embodiments of the present disclosure.
Figure 3:
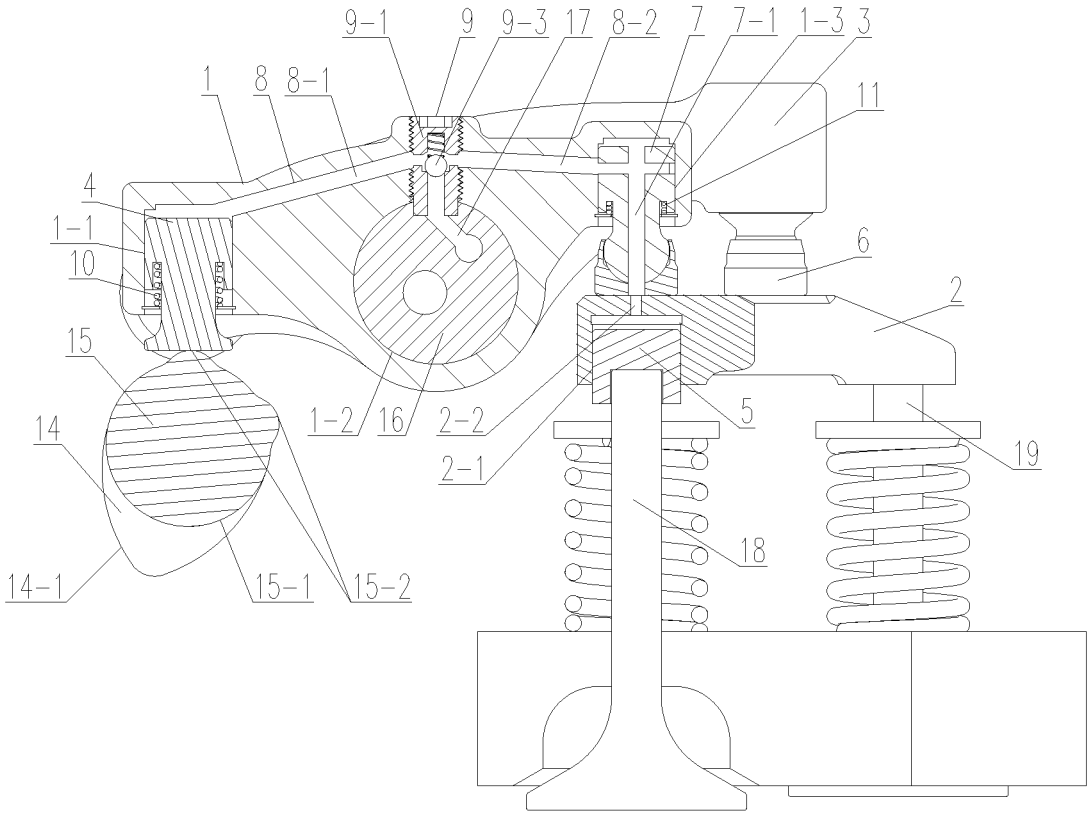
FIG. 3 is an exemplary schematic diagram illustrating the specialized actuating cam actuating an actuating valve to be displaced according to some embodiments of the present disclosure.
Figure 4:
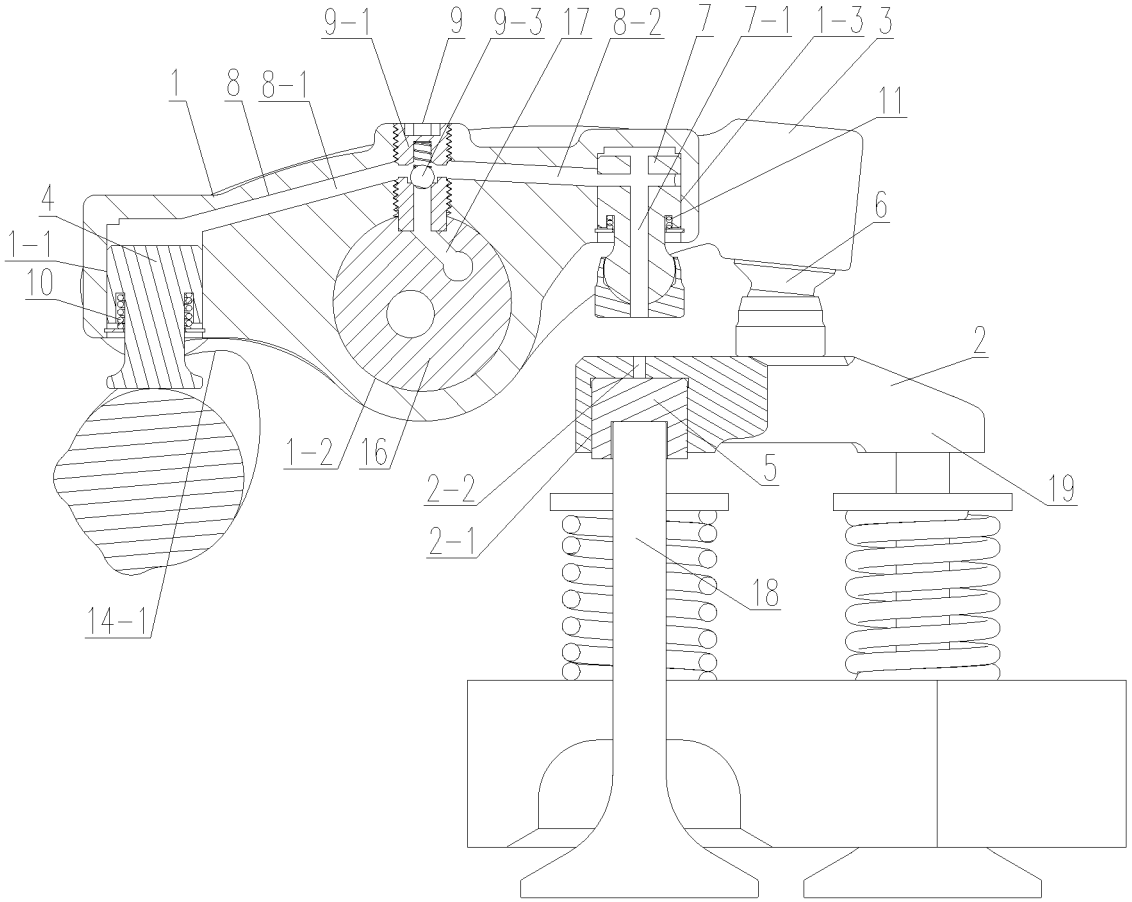
FIG. 4 is an exemplary schematic diagram illustrating a rocker arm driving a valve bridge to be displaced according to some embodiments of the present disclosure.
Figure 5:
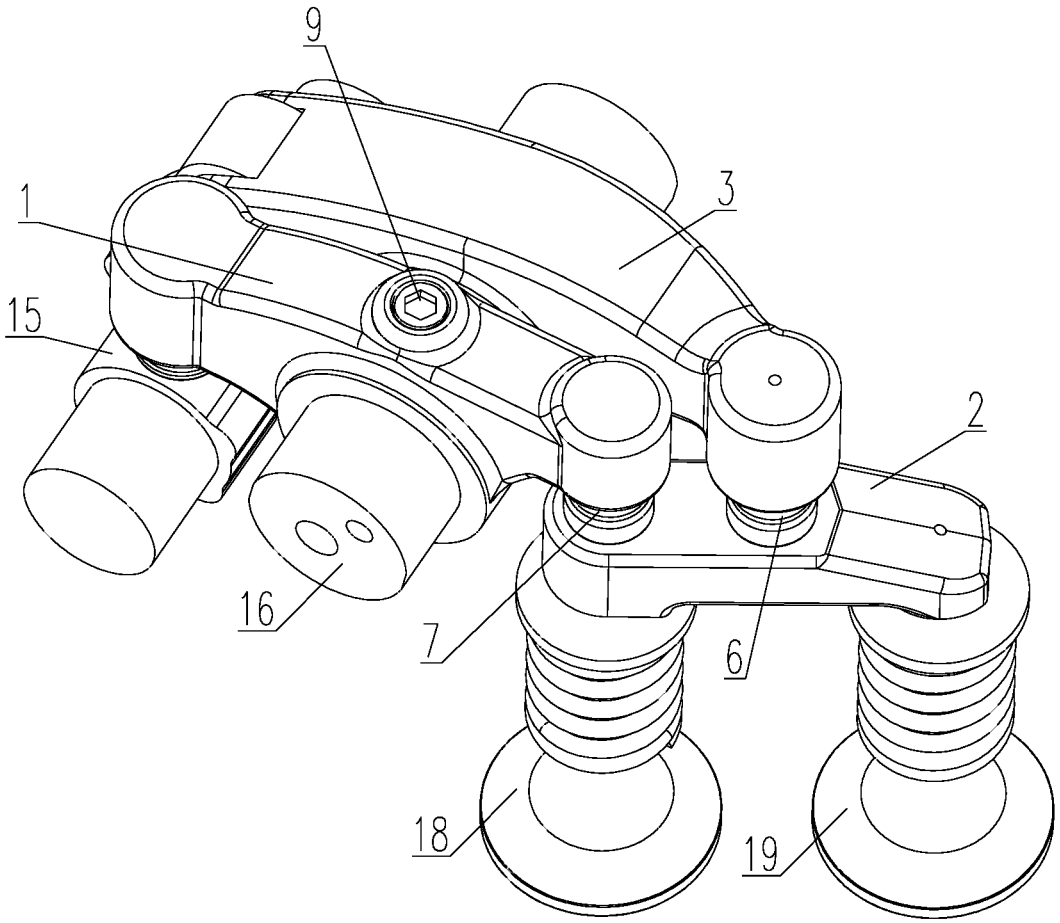
FIG. 5 is a schematic diagram illustrating an exemplary three-dimensional view of a combined valve actuating device with a specialized actuating cam for hydraulic lash self-adjustment according to some embodiments of the present disclosure.
Figure 6:
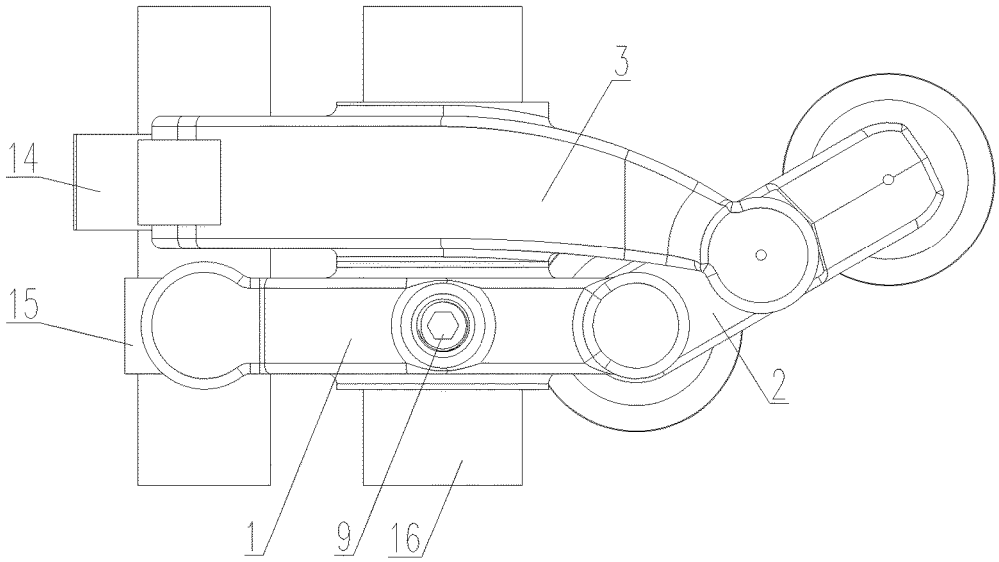
FIG. 6 is a schematic diagram illustrating an exemplary top view of a combined valve actuating device with a specialized actuating cam for hydraulic lash self-adjustment according to some embodiments of the present disclosure.
Figure 7:
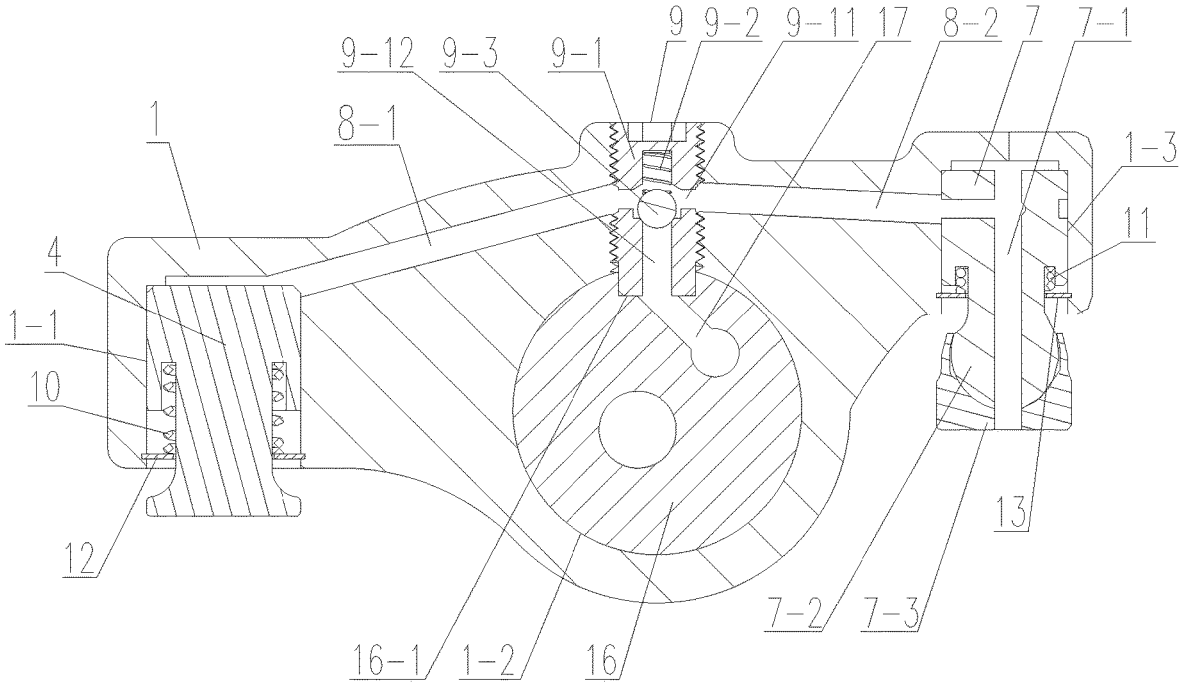
FIG. 7 is a schematic diagram illustrating an exemplary cross-sectional view of an actuator mounted on a rocker arm shaft according to some embodiments of the present disclosure.
Figure 8:
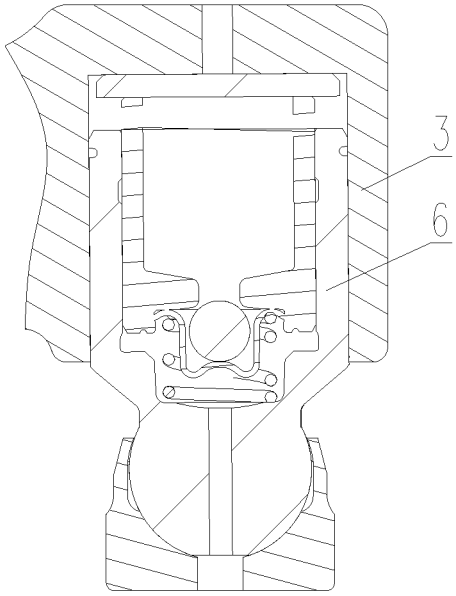
FIG. 8 is a schematic diagram illustrating an exemplary cross-sectional view of a hydraulic lash adjuster mounted on a rocker arm according to some embodiments of the present disclosure.

FIG. 1 is a schematic diagram illustrating an exemplary separation between a specialized actuating cam and a primary piston according to some embodiments of the present disclosure. FIG. 2 is a schematic diagram illustrating an exemplary hydraulic linkage formed between the primary piston and a secondary piston according to some embodiments of the present disclosure. FIG. 3 is an exemplary schematic diagram illustrating the specialized actuating cam actuating an actuating valve to be displaced according to some embodiments of the present disclosure. FIG. 4 is an exemplary schematic diagram illustrating a rocker arm driving a valve bridge to be displaced according to some embodiments of the present disclosure. FIG. 5 is a schematic diagram illustrating an exemplary three-dimensional view of a combined valve actuating device with a specialized actuating cam for hydraulic lash self-adjustment according to some embodiments of the present disclosure. FIG. 6 is a schematic diagram illustrating an exemplary top view of a combined valve actuating device with a specialized actuating cam for hydraulic lash self-adjustment according to some embodiments of the present disclosure. FIG. 7 is a schematic diagram illustrating an exemplary cross-sectional view of an actuator mounted on a rocker arm shaft according to some embodiments of the present disclosure. FIG. 8 is a schematic diagram illustrating an exemplary cross-sectional view of a hydraulic lash adjuster mounted on a rocker arm according to some embodiments of the present disclosure. In some embodiments, as shown in FIGS. 1-8, an engine of the combined valve actuating device with the specialized actuating cam for the hydraulic lash self-adjustment is a four-stroke engine, and both an actuating valve 18 and a non-actuating valve 19 of a valve group are exhaust valves in the engine. In some embodiments, the valve actuating device includes an actuator 1, a rocker arm 3, a specialized actuating cam 15, a valve bridge 2 and a positioning and pressure control unit 9.

The actuator 1 has a primary piston 4 slidably mounted in a primary piston hole 1-1, an actuating piston 7 is slidably mounted in an actuating piston hole 1-3, and an actuating oil line 8 is connected between the primary piston hole 1-1 and the actuating piston hole 1-3, an inner oil line 7-1 is connected to the actuating piston hole 1-3 running through the actuating piston 7, and the actuator 1 is fixedly mounted on a rocker arm shaft 16.

The rocker arm 3 is mounted with a hydraulic lash adjuster 6, and the rocker arm 3 is rotationally mounted on the rocker arm shaft 16.

The specialized actuating cam 15 is disposed on one side of a positivity cam 14 of an engine and has a round base component 15-1 and an actuating lift boss 15-2 disposed on the round base component 15-1. There are two actuating lift bosses 15-2, including an exhaust gas recirculation actuating lift boss and a compression release actuating lift boss. The exhaust gas recirculation actuating lift boss is used to make the actuating valve 18 to perform an exhaust gas recirculation operation, and the compression release actuating lift boss is used to make the actuating valve 18 to perform a compression release operation.

The valve bridge 2 located below the actuating piston 7 and the hydraulic lash adjuster 6 has a secondary piston 5 slidably mounted in a secondary piston hole 2-1 and an oil drain line 2-2 connected to the secondary piston hole 2-1, the actuating valve 18 is connected to the secondary piston 5, the actuating piston 7 is disposed opposite to the valve bridge 2, and an effective area of action of the actuating piston 7 for being pushed by a fluid in the actuating piston hole 1-3 and moving in a sliding direction of the actuating piston 7 is smaller than an effective area of action of the secondary piston 5 for being pushed by the liquid in the secondary piston hole 2-1 and moving in a sliding direction of the secondary piston 5.

The actuating oil line 8 being connected to an oil supply line 17 through the positioning and pressure control unit 9. In a case in which the rocker arm 3 does not actuate the valve bridge 2 to be displaced and the oil supply line 17 supplies oil to the actuating oil line 8, the actuating piston 7 extends out to contact the valve bridge 2 under a hydraulic action of the actuating oil line 8, and the inner oil line 7-1 is connected to the oil drain line 2-2. When the specialized actuating cam 15 rotates to the round base component 15-1 and is in a sliding or rolling fit with the primary piston 4, the primary piston 4 extends out to contact the round base component 15-1 under the hydraulic action of the actuating oil line 8. When the specialized actuating cam 15 rotates to the actuating lift boss 15-2 and is in a sliding or rolling fit with the primary piston 4, the positioning and pressure control unit 9 blocks the actuating oil line 8 and the oil supply line 17, and a hydraulic linkage is formed between the primary piston 4 and the secondary piston 5 to make the actuating lift boss 15-2 to actuate the actuating valve 18 connected to the secondary piston 5 to be displaced through the primary piston 4. If there is a flat surface or curved surface on the primary piston 4, a fit of the round base component 15-1 and the actuating lift boss 15-2 with the primary piston 4 is that the round base component 15-1 and the actuating lift boss 15-2 are in contact with the flat surface or curved surface, so that the round base component 15-1 and the actuating lift boss 15-2 form the sliding fit with the primary piston 4, respectively. If there is a roller rotationally mounted on the primary piston 4, a fit of the round base component 15-1 and the actuating lift boss 15-2 with the primary piston 4 is that the round base component 15-1 and the actuating lift boss 15-2 are in contact with the roller, so that the round base component 15-1 and the actuating lift boss 15-2 form the rolling fit with the primary piston 4, respectively.

In a case in which the rocker arm 3 actuates the valve bridge 2 to be displaced through the hydraulic lash adjuster 6, the oil drain line 2-2 and the inner oil line 7-1 are separated with the displacement of the valve bridge 2, the hydraulic linkage between the primary piston 4 and the secondary piston 5 is released, oil in the secondary piston hole 2-1 is drained out, and the secondary piston 5 is reset within the valve bridge 2. It is worth noting that the structure driving the valve bridge 2 to be displaced by the rocker arm 3 when the positivity cam 14 rotates is a conventional technology. For example, when the positivity cam 14 rotates to a point where a round base of the positivity cam 14 fits with the rocker arm 3, neither the rocker arm 3 nor the valve bridge 2 is displaced; and when the positivity cam 14 rotates to a point where a primary lift boss 14-1 fits with the rocker arm 3, the primary lift boss 14-1 pushes the rocker arm 3, and the rocker arm 3 actuates the valve bridge 2 to be displaced through the hydraulic lash adjuster 6.

In some embodiments, the positivity cam 14 is located at one end of the rocker arm 3 and the hydraulic lash adjuster 6 is located at the other end of the rocker arm 3. The positivity cam 14, the hydraulic lash adjuster 6, and the valve bridge 2 are located below the rocker arm 3, and the primary piston 4, the specialized actuating cam 15, the actuating piston 7, and the valve bridge 2 are located below the actuator 1, and the actuating piston 7 is located between the rocker arm shaft 16 and the hydraulic lash adjuster 6, and the hydraulic lash adjuster 6 may be in contact with a middle part of an upper side of the valve bridge 2, which can improve the stability of the structure and can improve a load-carrying capacity.

In some embodiments, the oil supply line 17 may unidirectionally supply oil to the actuating oil line 8 through the positioning and pressure control unit 9, and when the hydraulic linkage exists between the primary piston 4 and the secondary piston 5, reverse cut-off of the positioning and pressure control unit 9 is utilized to force the oil in the actuating oil line 8 not to flow back into the oil supply line 17, thereby realizing a rigid hydraulic linkage between the primary piston 4 and the secondary piston 5.

In some embodiments, the actuator 1 may be provided with a shaft hole 1-2 matching the rocker shaft 16, the rocker shaft 16 passes through the shaft hole 1-2, and the actuator 1 is fixedly connected to the rocker shaft 16 through the positioning and pressure control unit 9, thereby improving compactness of the structure.

In some embodiments, the positioning and pressure control unit 9 may include a positioning screw 9-1 and a unidirectional component. The positioning screw 9-1 has an oil chamber 9-11 and an oil inlet line 9-12 connected to the oil chamber 9-11.

In some embodiments, the actuating oil line 8 includes a primary piston oil line 8-1 in the actuator 1 and an actuating piston oil line 8-2 in the actuator 1, one end of the primary piston oil line 8-1 is connected to the primary piston hole 1-1 and the other end of the primary piston oil line 8-1 is connected to the oil chamber 9-11, and one end of the actuating piston oil line 8-2 is connected to the oil chamber 9-11 and the other end of the actuating piston oil line 8-2 is connected to the inner oil line 7-1.

In some embodiments, the oil supply line 17 is disposed on the rocker arm shaft 16.

In some embodiments, the positioning and pressure control unit 9 composed of the positioning screw 9-1 and the unidirectional component has a simple structure. In addition, it is only necessary to tighten the positioning screw 9-1 on actuator 1, so that the positioning and pressure control unit 9 is fixed on the actuator 1 and the actuator 1 is fixed on the rocker arm shaft 16 simultaneously, thereby simplifying an assembly process and improving production efficiency.

In some embodiments, the positioning screw 9-1 is threadedly connected to the actuator 1 to fix the actuator 1 on the rocker arm shaft 16, the oil chamber 9-11 remains connected to the actuating oil line 8, the oil supply line 17 is connected to the oil inlet line 9-12, the unidirectional component is disposed on the positioning screw 9-1, and the oil inlet line 9-12 is unidirectionally connected to the oil chamber 9-11.

In some embodiments, the rocker arm shaft 16 is provided with a positioning surface 16-1 matching the positioning screw 9-1, and an end surface of an inner end of the positioning screw 9-1 is in contact with the positioning surface 16-1, so as to fix the actuator 1 on the rocker arm shaft 16. It is worth noting that the positioning screw 9-1 may fix the actuator 1 on the rocker arm shaft 16 in other ways, e.g., the positioning screw 9-1 may fix the actuator 1 on the rocker arm shaft 16 by directly pressing against an outer peripheral surface of the rocker arm shaft 16.

In some embodiments, the unidirectional component may include an elastic element 9-2 and a unidirectional ball 9-3. The elastic element 9-2 may be a compression spring. One end of the elastic element 9-2 is against an inner wall of the oil chamber 9-11, and the other end of the elastic element 9-2 is against a connection between the oil inlet line 9-12 and the oil chamber 9-11. The unidirectional ball 9-3 is against the connection between the oil inlet line 9-12 and the oil chamber 9-11 to prevent oil in the oil chamber 9-11 from entering the oil inlet line 9-12. However, when the oil inlet line 9-12 supplies oil to the oil chamber 9-11, the elastic element 9-2 may be compressed, the unidirectional ball 9-3 may open the connection between the oil inlet line 9-12 and the oil chamber 9-11, and the oil inlet line 9-12 is connected to the oil chamber 9-11, which can continue to simplify the structure of the positioning and pressure control unit 9 and reduce production costs. It is worth noting that in other embodiments, a unidirectional valve may also be used to replace the unidirectional component.

In some embodiments, the actuator 1 may be provided with a primary elastic element 10 used to actuate the primary piston 4 to retract when a pressure is released in the actuating oil line 8, so that the primary piston 4 is kept in an initial position when separated from the specialized actuating cam 15 using an elastic force of the primary elastic element 10. The primary piston 4 may only move to contact the specialized actuating cam 15 when the actuating oil line 8 is supplied with oil and the elastic force of the primary elastic element 10 is overcome using a hydraulic pressure. In some embodiments, the primary elastic element 10 may be a compression spring, and the primary elastic element 10 may be mounted in any feasible way. An exemplary mounting structure is as follows. An opening of the primary piston hole 1-1 faces downward, a primary elastic element support 12 is fixed at a lower end of the primary piston hole 1-1, and one end of the primary elastic element 10 is against the primary elastic element support 12 and the other end of the primary elastic element 10 is against the primary piston 4.

In some embodiments, the actuator 1 may be provided with an actuating elastic element 11. The actuating elastic element 11 may be a compression spring used to actuate the actuating piston 7 to retract when a pressure is released in the actuating oil line 8, an actuating piston limiting unit 13 is disposed at the actuating piston hole 1-3, and the actuating piston limiting unit 13 is configured to limit a maximum stroke of the actuating piston 7 along an axial direction of the actuating piston hole 1-3. Therefore, the actuating piston 7 is kept in an initial position when separated from the valve bridge 2 using the elastic force of the actuating elastic element 11. The actuating piston 7 may only move to contact the valve bridge 2 when the actuating oil line 8 is supplied with oil and the elastic force of the actuating elastic element 11 is overcome using the hydraulic pressure. An example mounting structure is as follows. An opening of the actuating piston hole 1-3 faces downward, the actuating piston limiting unit 13 is fixed at a lower end of the actuating piston hole 1-3, one end of the actuating elastic element 11 is against the actuating piston limiting unit 13 and the other end of the actuating elastic element 11 is against the actuating piston 7. When the actuating piston 7 contacts with the actuating piston limiting unit 13, the actuating piston 7 reaches a maximum stroke of downward displacement. In order to realize a stable sealing contact between the actuating piston 7 and the valve bridge 2, the actuating piston 7 is provided with an actuating piston joint portion 7-2 and an actuating piston joint seat 7-3, and a spherical sub-connection or a rotating sub-connection is formed between the actuating piston joint seat 7-3 and the actuating piston joint portion 7-2. The actuating piston joint seat 7-3 is used to contact the valve bridge 2, and the inner oil line 7-1 runs through the actuating piston 7, the actuating piston joint portion 7-2, and the actuating piston joint seat 7-3 in sequence.

In some embodiments, a working principle of the combined valve actuating device with the specialized actuating cam for the hydraulic lash self-adjustment is as follows.

A cam shaft of the engine actuates the positivity cam 14 and the specialized actuating cam 15 to rotate.

If a solenoid valve of the engine is closed, the oil supply line 17 stops supplying oil, and there is no oil pressure in the actuating oil line 8. As shown in FIG. 1, the primary piston 4 and the actuating piston 7 integrated in the actuator 1 are in a closed position under the action of a spring force and are separated from the specialized actuating cam 15 and the valve bridge 2, respectively. When the specialized actuating cam 15 rotates, the specialized actuating cam 15 is not in contact with the primary piston 4 of the actuator 1, and actuating lift of the specialized actuating cam 15 is not transmitted to the actuator 1 and the actuating valve 18. Only when the positivity cam 14 rotates to positivity lift, the positivity lift rotates through the rocker arm 3 and the hydraulic lash adjuster 6 actuates the valve bridge 2 to be displaced, and the actuating valve 18 and the non-actuating valve 19 are opened simultaneously to complete the usual valve positivity lift.

When the solenoid valve of the engine is opened, as shown in FIG. 2, the oil supply line 17 supplies oil unidirectionally to the actuating oil line 8 through the unidirectional component in the positioning and pressure control unit 9 when the positivity cam 14 is in the round base and the specialized actuating cam 15 is in the round base component 15-1. After the actuating oil line 8 is supplied with oil, the oil therein causes the primary piston 4 and the actuating piston 7 to overcome the spring force and extend to contact the specialized actuating cam 15 and the valve bridge 2 without a lash, respectively. At this point, the actuating piston 7 is sealed with the valve bridge 2, and the inner oil line 7-1 moves to connect with the oil drain line 2-2.

As shown in FIG. 3, when the specialized actuating cam 15 rotates to a point where the actuating lift boss 15-2 is in contact with the primary piston 4, the actuating lift boss 15-2 pushes and actuates the primary piston 4, the unidirectional component in the positioning and pressure control unit 9 is closed due to hydraulic backflow, and the actuating oil line 8 is closed. The hydraulic linkage is formed between the primary piston 4 and the secondary piston 5, and the secondary piston 5 is displaced with the primary piston 4. Accordingly, the actuating valve 18 connected to the secondary piston 5 is actuated and opened by the secondary piston 5 in the valve bridge 2, so that the engine opens the actuating valve 18 according to the actuating lift of the specialized actuating cam 15.

As shown in FIG. 4, when the positivity cam 14 begins to rotate to a point where the primary lift boss 14-1 contacts the primary piston 4, the rocker arm 3 pushes the valve bridge 2 downward, the actuating valve 18 and the non-actuating valve 19 achieve the positivity lift, and at the same time, the valve bridge 2 is separated from the actuating piston 7. At this time, the oil drain line 2-2 in the valve bridge 2 is automatically opened, the oil in the secondary piston hole 2-1 is drained out through the oil drain line 2-2 under the action of a pressure of the actuating valve 18, and the secondary piston 5 is reset and retracted to an unextended position so that the entire valve is restored to a positivity attitude.

When the actuating piston oil line 8-2 is connected to the actuating piston hole 1-3 through the inner oil line 7-1, an upper opening of the inner oil line 7-1 is located on an upper end surface of the actuating piston 7. In this case, if the inner oil line 7-1 is an equal diameter hole, a difference between a cross-sectional area of a sliding connection part between an inner peripheral wall of the actuating piston hole 1-3 and the actuating valve 7 and a cross-sectional area of the inner oil line 7-1 is an effective area of action of the actuating piston 7. If the inner oil line 7-1 is a two-stage stepped hole with a large upper end and a small lower end, a difference between the cross-sectional area of the sliding connection part between the inner peripheral wall of the actuating piston hole 1-3 and the actuating valve 7 and a minimum value of the cross-sectional area of the inner oil line 7-1 is the effective area of action of the actuating piston 7. If the inner oil line 7-1 is a two-stage stepped hole with a small upper end and a large lower end, a difference between the cross-sectional area of the sliding connection part between the inner peripheral wall of the actuating piston hole 1-3 and the actuating piston 7 and a maximum value of the cross-sectional area of the inner oil line 7-1 is the effective area of action of the actuating piston 7.

When the actuating piston oil line 8-2 is connected to the actuating piston hole 1-3 through an upper end of the actuating piston hole 1-3 (i.e., the upper opening of the inner oil line 7-1 is not located on the upper end surface of the actuating piston 7), in this case, the cross-sectional area of the sliding connection part between the inner peripheral wall of the actuating piston hole 1-3 and the actuating piston 7 is the effective area of action of the actuating piston 7.

A cross-sectional area of a sliding connection part between an inner peripheral wall of the secondary piston hole 2-1 and the secondary piston 5 is an effective area of action of the secondary piston 5.

The effective area of action of the actuating piston 7 is designed to be smaller than the effective area of action of the secondary piston 5, so that the valve bridge 2 is subjected to an upward hydraulic differential force on a side of the actuating valve 18 during the actuating lift, so as to balance a downward thrust generated by the hydraulic lash adjuster 6 in a middle of the valve bridge 2 and prevent the hydraulic lash adjuster 6 from over-extending and increasing the positivity lift of the valve.

In some embodiments, the combined valve actuating device with the specialized actuating cam for the hydraulic lash self-adjustment further includes a temperature sensor, a pressure sensor, a flow sensor, a warning module, and a processor. The temperature sensor, the pressure sensor, the flow sensor, and the warning module are all connected to the processor through signals.

The temperature sensor may be used to detect a temperature such as an environmental temperature, a liquid temperature (e.g., an oil temperature), etc. In some embodiments, the temperature sensor may be disposed in the oil drain line 2-2, so that the temperature sensor may detect the oil temperature when the oil is drained out.

The pressure sensor may be used to detect pressure, such as an air pressure, a liquid pressure (e.g., an oil pressure), etc. In some embodiments, the pressure sensor may be disposed in the oil drain line 2-2, so that the pressure sensor may detect the oil pressure when the oil is drained out.

The flow sensor may be used to detect a flow rate, a flow velocity, etc. of a flowing liquid, etc. In some embodiments, the flow sensor may be disposed in the oil drain line 2-2, so that the flow sensor may detect a flow velocity of the oil (i.e., an oil velocity) when the oil is drained out.

The processor may be used to receive data, analyze and process the received data, generate a corresponding control instruction based on a processing result, and send a processing instruction to an actuating mechanism to perform a corresponding action. In some embodiments, the processor may receive the oil temperature, the oil pressure, and the oil velocity detected by the temperature sensor, the pressure sensor, and the flow sensor. The processor may record the oil temperature chronologically to form a sequence of oil temperature features, the processor may record the oil pressure chronologically to form a sequence of oil pressure features, and the processor may record the oil velocity chronologically to form a sequence of oil velocity features.

In some embodiments, the processor may be configured to: collect the oil temperature, the oil pressure, and the oil velocity in the oil drain line 2-2 when the actuating device automatically drains out oil for each time and determine an abnormality probability of the actuating device based on the oil temperatures, the oil pressure, and the oil velocity when the actuating device drains out oil one or more times during a working cycle. The working cycle refers to a time interval between each repetition of one or more actions of a structure that performs a cyclic action in the engine. For example, a time interval between one or more reciprocating movements of a piston in the engine may be taken as one working cycle. The abnormality probability of the actuating device refers to a probability of the actuating device experiencing an abnormal condition such as an abnormal temperature, damage, or failure.

In some embodiments, the processor may determine the abnormality probability of the actuating device based on the sequence of oil temperature features, the sequence of oil pressure features, and the sequence of oil velocity features when the oil is automatically drained out one or more times during the working cycle. For example, the processor may construct a vector to be matched based on the sequence of oil temperature features, the sequence of oil pressure features, and the sequence of oil velocity features, match in a vector database base on the vector to be matched, determine each of one or more target vectors whose matching similarity satisfies a similarity threshold, and determine the abnormality probability of the actuating device based on a ratio of target vectors in which abnormalities have occurred historically to the target vectors. The greater the ratio of the target vectors in which the abnormalities have occurred historically, the greater the abnormality probability of the actuating device. In some embodiments, there may be a predetermined relationship between the ratio of the target vectors in which the abnormalities have occurred historically to the target vectors and the abnormality probability of the actuating device. The abnormality probability of the actuating device may be determined based on the predetermined relationship after the ratio of the target vectors in which the abnormalities have occurred historically to the target vectors may be obtained.

The warning module may be used to issue an alarm to alert a user. For example, the warning module may issue the alarm through flashing lights, sounds, text displays, etc. In some embodiments, the warning module may be connected to the processor through the signal, and the processor may send the control command to the warning module to make the warning module issue the alarm. In some embodiments, the warning module may be a part of the processor.

In some embodiments, the processor may control the warning module to issue the alarm in response to a determination that the abnormality probability of the actuating device is greater than a predetermined probability threshold. The user may perform processing (e.g., repairing or replacing components) on the actuating device timely according to the alarm issued by the warning module.

In some embodiments of the present disclosure, the parameters such as the oil temperature, the oil pressure, or the oil velocity may be detected in real time through the temperature sensor, the pressure sensor, and the flow sensor, and it may be determined whether the actuating device is in an abnormal state based on the detected parameters. The processor enables automated control and facilitates automated data collection. The warning module may alarm in time when an abnormality occurs, thereby reminding the user to deal with the abnormality in time.

In some embodiments, the processor may construct an oil line map based on a physical connection structure of one or more oil drain lines 2-2 of the actuating device, locations of the sensors, and the oil temperature, the oil pressure, and the oil velocity.

The oil line map may be used to represent the oil drain line 2-2 and an oil feature of the oil in the drain line 2-2 when drained out. In some embodiments, the oil line map may include a node and an edge. In some embodiments, the node may include a sensor node and an oil line intersection node. The sensor node is a node where the sensor (including the temperature sensor, the pressure sensor, and the flow sensor) is deployed; and the oil line intersection node is a node where two or more oil lines intersect. In some embodiments, a same node may be both the sensor node and the oil line intersection node when the sensor is mounted at an intersection of two or more oil lines.

In some embodiments, a node feature of the sensor node may include the oil temperature, the oil pressure, and the oil velocity, and may further include a moment at which the oil temperature, the oil pressure, and the oil velocity are collected. Understandably, the node feature of the sensor node may need to be adapted to the sensor deployed at the node. For example, if the temperature sensor is deployed at the sensor node, the node feature of the sensor node includes the oil temperature and a moment at which the oil temperature is collected. In some embodiments, the oil line intersection node may have no node feature.

In some embodiments, the edge may be formed according to a connection structure between the oil lines, and there is an edge between two adjacent nodes. In some embodiments, an edge feature may include a distance between two nodes along a direction of the oil line. The distance is not a straight line distance but an actual length of an oil line between two nodes, or a curved distance if the oil line is curved.

In some embodiments, the processor may determine the abnormality probability of the valve actuating device based on the oil line map through an abnormality probability determination model. The abnormality probability determination model is a machine learning model, e.g., a graph neural network (GNN) model.

In some embodiments, an input of the abnormality probability determination model may include the oil line map, and an output of the abnormality probability determination model may be an abnormality probability of a location corresponding to each node of the oil line map. The location corresponding to each node of the oil line map is a location corresponding to each node in the actuating device.

In some embodiments, the abnormality probability determination model may be obtained by training based on a plurality of first training samples with first labels. The plurality of first training samples with the first labels may be input into an initial abnormality probability determination model, a loss function may be constructed based on the first labels and a result of the initial abnormality probability determination model, and a parameter of the initial abnormality probability determination model may be iteratively updated based on the loss function. When the loss function of the initial abnormality probability determination model satisfies a preset condition, the model training is completed and a trained abnormality probability determination model is obtained. The preset condition may be that the loss function converges, a count of iterations reaches a threshold, etc.

In some embodiments, the first training sample may include a sample oil line map. The label of the first training sample may include an actual abnormality probability of an actuating device corresponding to the sample oil line map. In some embodiments, the first training sample and the first label may be obtained based on historical data. The first label may be manually labeled.

In some embodiments of the present disclosure, the oil line map is constructed based on the connection structure of the oil drain lines and the oil feature of the oil in the oil drain lines when drained out, and the abnormality probability of the actuating device is determined through the abnormality probability determination model based on the oil line map, thereby accurately predicting the abnormality probability of the location corresponding to each node of the oil line map.

In some embodiments, the edge feature may also include an average curvature of the oil line between two nodes. The oil line may include a straight oil line and a curved oil line, and the oil has different force situations when advancing in the straight oil line and the curved oil line. Therefore, the average curvature of the oil line may have an effect on the abnormality probability of the actuating device, and the average curvature may be input into the abnormality probability determination model as the edge feature, which can improve the accuracy of the prediction result of the model.

Figure 9:
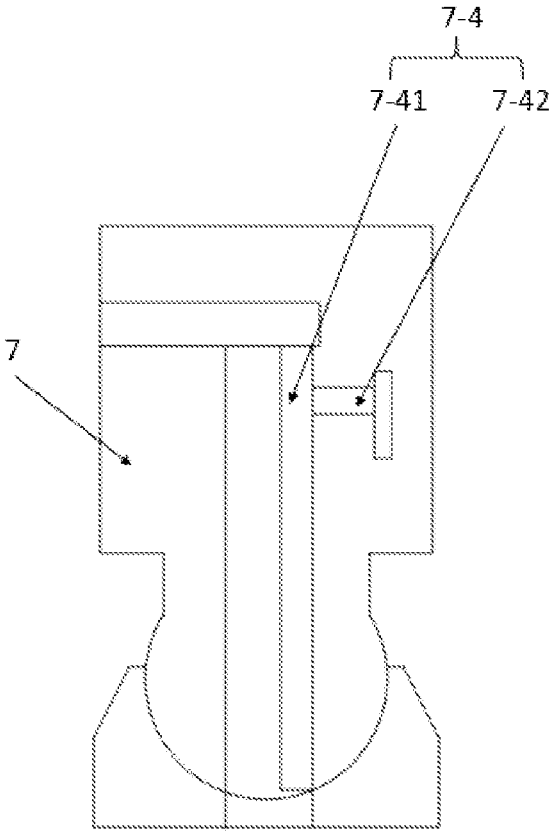
FIG. 9 is a schematic diagram illustrating an exemplary installation of an oil line area adjusting mechanism according to some embodiments of the present disclosure.
Figure 10:
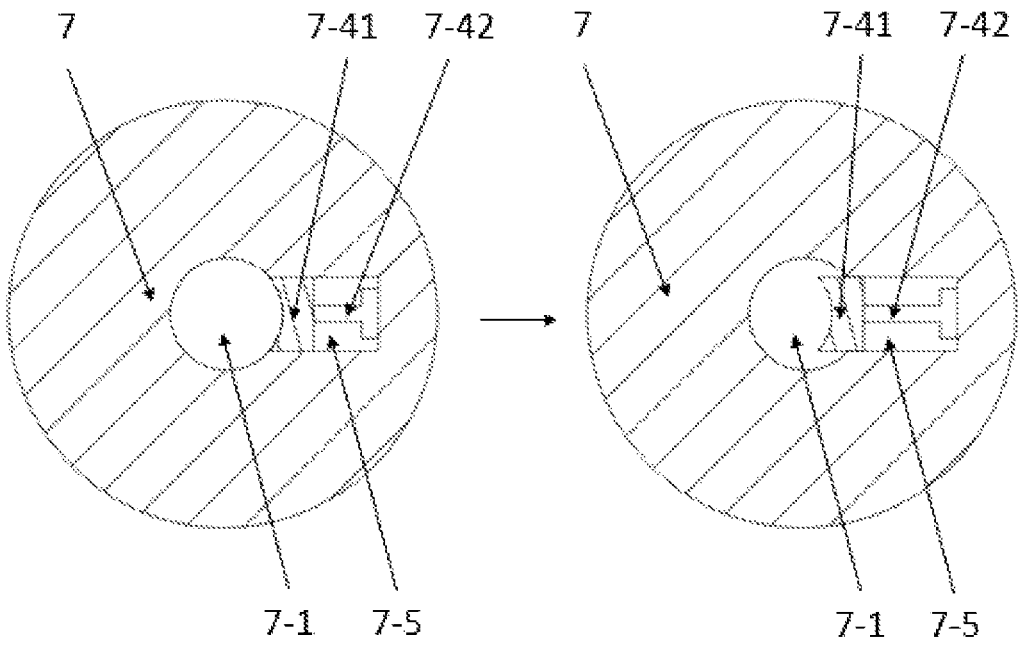
FIG. 10 is a schematic diagram illustrating an exemplary adjustment of an oil line area adjusting mechanism according to some embodiments of the present disclosure.

FIG. 9 is a schematic diagram illustrating an exemplary installation of an oil line area adjusting mechanism according to some embodiments of the present disclosure. FIG. 10 is a schematic diagram illustrating an exemplary adjustment of an oil line area adjusting mechanism according to some embodiments of the present disclosure. In some embodiments, as shown in FIG. 9, a combined valve actuating device with a specialized actuating cam for hydraulic lash self-adjustment may also include the oil line area adjusting mechanism 7-4. In some embodiments, the oil line area adjusting mechanism 7-4 may be disposed in an oil line of the actuating piston 7. For example, the actuating piston 7 is provided with an accommodating groove for accommodating the oil line area adjusting mechanism 7-4, and the oil line area adjusting mechanism 7-4 may be disposed in the accommodating groove. In some embodiments, the oil line area adjusting mechanism 7-4 may be tightly connected to an end surface of the inner oil line 7-1.

The oil line area adjusting mechanism 7-4 may be used to adjust an effective area of action of the inner oil line 7-1 of the actuating piston 7, so that a flow velocity of oil in the actuating piston 7 may be adjusted. In some embodiments, the oil line area adjusting mechanism 7-4 may include an adjusting block 7-41 and a push rod 7-42. The adjusting block 7-41 is connected to the push rod 7-42. In some embodiments, a width of the adjusting block 7-41 may be smaller than a diameter of the oil line of the actuating piston 7. In some embodiments, as shown in FIG. 10, the push rod 7-42 may push the adjusting block 7-41 to move along a radial direction of the inner oil line 7-1 of the actuating piston 7 from a circumference to a center of a circle, so as to create an obstruction for the oil line, thereby reducing the effective area of action of the inner oil line 7-1 of the actuating piston 7. In some embodiments, the effective area of action of the inner oil line 7-1 of the actuating piston 7 may be changed (i.e., the effective area of action of the actuating piston 7 may be changed) by pushing the push rod 7-42 to change a volume occupied by the adjusting block 7-41 in the oil line.

In some embodiments, the accommodating groove 7-5 and the inner oil line 7-1 are closed through the adjusting block 7-41, so that the oil in the inner oil line 7-1 may not enter the accommodating groove 7-5. In some embodiments, the adjusting block 7-41 may be set as dynamically sealed with the accommodating groove 7-5. In some embodiments, as shown in FIG. 10, the adjusting block 7-41 moves relative to the accommodating groove 7-5 when pushed by the push rod 7-42, and the accommodating groove 7-5 keeps sealed with the inner oil line 7-1 through the adjusting block.

In some embodiments, the secondary piston 5 may include a multi-stage annular piston and a multi-stage piston actuating mechanism, and an effective area of action of the secondary piston 5 may be determined by the multi-stage piston actuating mechanism actuating the multi-stage annular piston to move.

In some embodiments, the multi-stage annular piston and the multi-stage piston actuating mechanism may be disposed in the secondary piston 5. The multi-stage annular piston may include a plurality of annular structures of different diameters. Two adjacent annular structures may slide relative to each other. In some embodiments, among the two adjacent annual structures, an outer diameter of a relatively small annular structure is equal to an inner diameter of a relatively large annual structure. In some embodiments, a cross-sectional shape of a contact surface between each annular structure and the oil may be sharp-edged or rounded. In some embodiments, an overall shape of a contact surface between the multi-stage annular piston and the oil may be planar. Each annular structure may extend or retract by a different distance, which may make the overall shape of the contact surface between the multi-stage annular piston and the oil change from a planar surface to an outwardly convex or inwardly concave spherical surface, thereby realizing the adjustment of the effective area of action of the secondary piston 5.

In some embodiments, the plurality of annular structures may be connected to the multi-stage piston actuating mechanism, respectively. The multi-stage piston actuating mechanism may include a plurality of actuating units. The plurality of actuating units are connected to the plurality of annular structures in one-to-one correspondence, respectively. In some embodiments, the plurality of actuating units may simultaneously actuate the plurality of annular structures to move reciprocally, and at least one of the plurality of actuating units may also actuate an annular piston unit corresponding to the actuating unit to move reciprocally separately.

In some embodiments of the present disclosure, the plurality of annular structures of the multi-stage annular piston may be controlled to move using the multi-stage piston actuating mechanism by providing the multi-stage annular piston, so that the effective area of action of the secondary piston 5 in contact with the oil may be changed as required.

In some embodiments, when the actuating device works, a processor may determine a preferred effective area of action combination based on a thrust sequence consisting of downward thrusts generated by the hydraulic lash adjuster 6 in a middle of the valve bridge 2 at one or more moments. In some embodiments, the preferred effective area of action combination includes a preferred effective area of action of the actuating piston 7 and a preferred effective area of action of the secondary piston 5.

In some embodiments, the processor may determine the preferred effective area of action combination based on the thrust sequence in a plurality of feasible ways, such as by querying a preset table. In some embodiments, the processor may determine the preferred effective area of action combination through an area of action combination recommendation model based on the thrust sequence. The area of action combination recommendation model is a machine learning model, e.g., a deep neural network (DNN) model.

In some embodiments, an input of the area of action combination recommendation model may include the thrust sequence and an output of the area of action combination recommendation model may be the preferred effective area of action combination. The preferred effective area of action combination may be a preferred effective area of action combination within a predetermined time period in the future, such as a preferred effective area of action combination within 5 seconds in the future.

In some embodiments, the area of action combination recommendation model may be obtained by training based on a plurality of second training samples with second labels. The plurality of second training samples with the second labels may be input into an initial area of action combination recommendation model, a loss function may be constructed through the second labels and a result of the initial area of action combination recommendation model, and a parameter of the initial area of action combination recommendation model may be iteratively updated based on the loss function. When the loss function of the initial area of action combination recommendation model satisfies a preset condition, the model training is completed and a trained area of action combination recommendation model is obtained. The preset condition may be that the loss function converges, a count of iterations reaches a threshold, etc.

In some embodiments, the second training sample may at least include a sample thrust sequence. The second training sample may be obtained based on historical data. The second label may be determined through historical data or simulation experiments under a condition of the sample thrust sequence. In some embodiments, under a condition of a certain sample thrust sequence, an amount of extension of the hydraulic gap adjuster 6 corresponding to times when different effective area of action combinations of the actuating piston 7 and the secondary piston 5 are executed is selected within the predetermined time period in the future, and an effective area of action corresponding to a time when the amount of extension is optimal is determined as the label for the sample thrust sequence. The second label may be manually labeled.

In some embodiments, the amount of extension is considered to be optimal if the amount of extension is within a predetermined standard range. The predetermined standard range may be empirically determined.

In some embodiments of the present disclosure, the preferred effective area of action of the actuating piston 7 and the preferred effective area of action of the secondary piston 5 within the future time period may be predicted through the area of action combination recommendation model, and the actuating device may be adjusted accordingly based on the preferred effective areas of action, which can improve the control precision of the actuating device.

In some embodiments, the input of the area of action combination recommendation model may further include an abnormality probability of a location corresponding to each node of an oil line map. The abnormality probability of the location corresponding to each node of the oil line map may be the output of the abnormality probability determination model, which can reflect an overall intrinsic feature of the combined valve actuating device with the specialized actuating cam for the hydraulic lash self-adjustment. Therefore, the area of action combination recommendation model may obtain a lower-risk and better output by inputting the abnormality probability of the location corresponding to each node of the oil line map into the area of action combination recommendation model.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or feature described in connection with the embodiment is included in at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. In addition, some features, structures, or features in the present disclosure of one or more embodiments may be appropriately combined.

Some embodiments may use numbers to describe the quantity of components or attributes. It should be understood that such numbers used for the description of embodiments may be modified with qualifying terms such as "about," "approximately," or "substantially." Unless otherwise stated, these qualifying terms indicate that the numbers allow for a variation of ±20%. Accordingly, in some embodiments, the numerical parameters used in the present disclosure and claims are approximate values, which may vary depending on specific embodiments' requirements. In some embodiments, numerical parameters should be construed to include the specified number of significant digits and the means of general rounding off. Although the numerical ranges and parameters provided in some embodiments of the present disclosure are approximate values, the setting of such numerical values in specific embodiments is as accurate as possible within the feasible range.

What is claimed is:

1. A combined valve actuating device with a specialized actuating cam for hydraulic lash self-adjustment, comprising:

an actuator, the actuator having a primary piston slidably mounted in a primary piston hole, an actuating piston slidably mounted in an actuating piston hole, and an actuating oil line connected between the primary piston hole and the actuating piston hole, an inner oil line connected to the actuating piston hole running through the actuating piston, and the actuator being fixedly mounted on a rocker arm shaft;

a rocker arm, the rocker arm being mounted with a hydraulic lash adjuster, and the rocker arm being rotationally mounted on the rocker arm shaft;

the specialized actuating cam, the specialized actuating cam being disposed on one side of a positivity cam of an engine and having a round base component and an actuating lift boss disposed on the round base component;

a valve bridge located below the actuating piston and the hydraulic lash adjuster, the valve bridge having a secondary piston slidably mounted in a secondary piston hole and an oil drain line connected to the secondary piston hole and an actuating valve being connected to the secondary piston, the actuating piston being disposed opposite to the valve bridge, wherein an effective area of action of the actuating piston for being pushed by a liquid in the actuating piston hole and moving in a sliding direction of the actuating piston is smaller than an effective area of action of the secondary piston for being pushed by a liquid in the secondary piston hole and moving in a sliding direction of the secondary piston; and a positioning and pressure control unit, the actuating oil line being connected to an oil supply line through the positioning and pressure control unit, wherein, when the rocker arm does not actuate the valve bridge and the oil supply line supplies oil to the actuating oil line, the actuating piston extends out to contact the valve bridge under a hydraulic action of the actuating oil line, and the inner oil line is connected to the oil drain line; when the specialized actuating cam rotates to the round base component and is in a sliding or rolling fit with the primary piston, the primary piston extends out to contact the round base component under the hydraulic action of the actuating oil line; and when the specialized actuating cam rotates to the actuating lift boss and is in the sliding or rolling fit with the primary piston, the positioning and pressure control unit blocks the actuating oil line and the oil supply line, and a hydraulic linkage is formed between the primary piston and the secondary piston to make the actuating lift boss to actuate the actuating valve connected to the secondary piston to be displaced through the primary piston; or wherein, when the rocker arm actuates the valve bridge to be displaced through the hydraulic lash adjuster, the oil drain line and the inner oil line are separated with the displacement of the valve bridge, the hydraulic linkage between the primary piston and the secondary piston is released, oil in the secondary piston hole is drained out, and the secondary piston is reset within the valve bridge;

the oil supply line unidirectionally supplies oil to the actuating oil line through the positioning and pressure control unit;

the actuator is provided with a shaft hole matching the rocker arm shaft, the rocker arm shaft passes through the shaft hole, and the actuator is fixedly connected to the rocker arm shaft through the positioning and pressure control unit;

the positioning and pressure control unit includes a positioning screw and a unidirectional component, the positioning screw has an oil chamber and an oil inlet line connected to the oil chamber, and the oil supply line is disposed on the rocker arm shaft; and the positioning screw is threadedly connected to the actuator to fix the actuator on the rocker arm shaft, the oil chamber remains connected to the actuating oil line, the oil supply line is connected to the oil inlet line, and the unidirectional component is disposed on the positioning screw and the oil inlet line is unidirectionally connected to the oil chamber.

2. The combined valve actuating device with the specialized actuating cam for the hydraulic lash self-adjustment of claim 1, wherein the positivity cam is located at one end of the rocker arm, the hydraulic lash adjuster is located at the other end of the rocker arm, the positivity cam, the hydraulic lash adjuster, and the valve bridge are located below the rocker arm, the primary piston, the specialized actuating cam, the actuating piston, and the valve bridge are located below the actuator.

3. The combined valve actuating device with the specialized actuating cam for the hydraulic lash self-adjustment of claim 1, wherein the actuating piston is located between the rocker arm shaft and the hydraulic lash adjuster.

4. The combined valve actuating device with the specialized actuating cam for the hydraulic lash self-adjustment of claim 1, wherein the rocker arm shaft is provided with a positioning surface matching the positioning screw, and an end surface of an inner end of the positioning screw is in contact with the positioning surface.

5. The combined valve actuating device with the specialized actuating cam for the hydraulic lash self-adjustment of claim 1, wherein the unidirectional component includes an elastic element and a unidirectional ball, one end of the elastic element is against an inner wall of the oil chamber, and the other end is within a connection between the oil inlet line and the oil chamber.

6. The combined valve actuating device with the specialized actuating cam for the hydraulic lash self-adjustment of claim 1, wherein the actuating oil line includes a primary piston oil line in the actuator and an actuating piston oil line in the actuator, one end of the primary piston oil line is connected to the primary piston hole and the other end of the primary piston oil line is connected to the oil chamber, one end of the actuating piston oil line is connected to the oil chamber, and the other end of the actuating piston oil line is connected to the inner oil line.

7. The combined valve actuating device with the specialized actuating cam for the hydraulic lash self-adjustment of claim 1, wherein the actuator is provided with a primary elastic element used to actuate the primary piston to retract when a pressure is released in the actuating oil line.

8. The combined valve actuating device with the specialized actuating cam for the hydraulic lash self-adjustment of claim 1, wherein the actuator is provided with an actuating elastic element used to actuate the actuating piston to retract when a pressure is released in the actuating oil line, an actuating piston limiting unit is disposed at the actuating piston hole, and the actuating piston limiting unit is configured to limit a maximum stroke of the actuating piston along an axial direction of the actuating piston hole.

* * * * *